US010212984B2

(12) United States Patent
Cho

(10) Patent No.: US 10,212,984 B2
(45) Date of Patent: Feb. 26, 2019

(54) HEADWEAR

(71) Applicant: YUPOONG, INC., Seoul (KR)

(72) Inventor: Byoung-Woo Cho, Seoul (KR)

(73) Assignee: YUPOONG, INC., Seoul (KR)

( * ) Notice: Subject to any disclaimer, the term of this patent is extended or adjusted under 35 U.S.C. 154(b) by 0 days.

(21) Appl. No.: 14/732,382

(22) Filed: Jun. 5, 2015

(65) Prior Publication Data

US 2016/0000172 A1 Jan. 7, 2016

(30) Foreign Application Priority Data

Jul. 4, 2014 (KR) ..... 10-2014-0083620

(51) Int. Cl.
*A42B 1/06* (2006.01)
*A42C 5/02* (2006.01)

(52) U.S. Cl.
CPC ..... *A42C 5/02* (2013.01); *A42B 1/062* (2013.01)

(58) Field of Classification Search
CPC ..... A42C 5/02; A42B 1/062; A42B 1/069
USPC ..... 2/181
See application file for complete search history.

(56) References Cited

U.S. PATENT DOCUMENTS 6,115,844 A * 9/2000 Cho ..... A42C 5/02 2/175.1
2003/0226192 A1 12/2003 Wang
2005/0120462 A1* 6/2005 Cho ..... A42B 1/062 2/195.2
2005/0155135 A1* 7/2005 Cho ..... A42B 1/062 2/172
2005/0160518 A1* 7/2005 Cho ..... A42B 1/06 2/181
2005/0160519 A1* 7/2005 Cho ..... A42C 5/02 2/181
2006/0048275 A1* 3/2006 Cho ..... A42C 5/02 2/195.1
2007/0079424 A1* 4/2007 Cho ..... A42C 5/02 2/195.1
2007/0157366 A1* 7/2007 Cho ..... A42C 5/02 2/181
2011/0072554 A1* 3/2011 Koh ..... A42C 5/02 2/181
2011/0072555 A1* 3/2011 Asiatico ..... A42C 5/02 2/181.4

(Continued)

FOREIGN PATENT DOCUMENTS

JP 5078682 B2 11/2012
KR 10-2006-0068783 A 6/2006

(Continued)

*Primary Examiner* — Sally Haden
(74) *Attorney, Agent, or Firm* — Lex IP Meister, PLLC

(57) ABSTRACT

The present invention provides a headwear comprising a head receiving portion and a visor/peak, which is substantially improved in sweat absorption and evaporation performance, thereby achieving superior stain-resistant properties. A headwear according to the present invention comprises: a sweat band coupled along an inner lower edge of the crown including a sweat absorbing portion to absorb sweat and a sweat storing portion to store the sweat absorbed to the sweat absorbing portion; and a sweat evaporating portion surrounding at least a part of the visor of the headwear to evaporate moisture from the sweat stored in the sweat band by being connected with the sweat band.

10 Claims, 3 Drawing Sheets

(56) References Cited

U.S. PATENT DOCUMENTS

| | | | | |
|---|---|---|---|---|
| 2011/0191937 | A1* | 8/2011 | Wang | A42C 5/02 2/181 |
| 2011/0302695 | A1* | 12/2011 | Cho | A42C 5/02 2/181 |
| 2013/0247281 | A1* | 9/2013 | Zebouni | A42C 5/02 2/272 |

FOREIGN PATENT DOCUMENTS

| | | | |
|---|---|---|---|
| KR | 10-0607564 | A | 6/2006 |
| KR | 20090129106 | A | 12/2009 |

* cited by examiner

HEADWEAR

CROSS REFERENCE TO RELATED APPLICATIONS

This application claims priority to and the benefit of Korean Patent Application No. 10-2014-0083620 filed in the Korean Intellectual Property Office on Jul. 4, 2014, the entire contents of which are incorporated herein by reference.

FIELD OF THE INVENTION

The present invention relates to a headwear. More particularly, the present invention relates to a headwear designed to improve both sweat absorption and evaporation and thereby to have superior stain-resistant properties.

BACKGROUND OF THE INVENTION

In general, a headwear (including a cap) comprises a crown which is a wearing portion worn on a head, and a visor or a peak attached to the crown.

When a headwear wearer sweats, the headwear should quickly absorb and evaporate sweat before getting wet so that the headwear may feel soft and dry to the wearer.

In addition, when a headwear does not properly function in sweat absorption and evaporation, it may become stained with sweat.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a headwear that is substantially improved in sweat absorption and evaporation performance and is thereby prevented from being stained due to the composition of sweat.

A headwear including a crown and a visor according to an exemplary embodiment of the present invention includes: a sweat band coupled along an inner lower edge of the crown, the sweat band including a stretchable sweat absorbing portion to absorb sweat and a stretchable sweat storing portion to store the sweat which is absorbed to the absorbing portion; and a sweat evaporating portion surrounding at least a part of the visor to evaporate moisture from the sweat stored in the storing portion by being connected with the sweat band.

The sweat absorbing portion may surround an inner surface of the sweat storing portion and a part of an outer surface of the sweat storing portion.

The headwear may further include a sweat evaporation-blocking portion surrounding the outer surface of the sweat storing portion to prevent evaporation of the sweat stored in the sweat storing portion toward the crown.

The sweat evaporation-blocking portion surrounds the outer surface of the sweat storing portion, and the sweat absorbing portion may surround the inner surface of the sweat storing portion and a part of the outer surface of the sweat evaporation-blocking portion.

The sweat evaporation-blocking portion may be formed of one of stretchable woven fabric, knit, band, non-woven fabric, and sheet.

The sweat evaporation-blocking portion may be water-repellent finished or waterproofed by a silicon-based agent.

The sweat evaporation-blocking portion may be coated with a polyurethane film or may be formed of polyurethane film.

The sweat absorbing portion may be made of stretchable woven fabric or knit.

The sweat absorbing portion may be made of a material including polyester, polypropylene, and polyurethane.

The sweat absorbing portion is made of a double jersey including a polyester layer and a polypropylene layer.

The polyester layer may be processed with a moisture-absorbent softener containing surfactant.

The sweat storing portion may be made of one of woven fabric, knit, band, non-woven fabric, and foam sheet.

The sweat storing portion includes a warp yarn and a weft yarn. As for the warp yarn, a plurality of warp yarns may be arranged in one direction, and the weft yarn may be arranged in a zigzag manner in a direction that is perpendicular to the arrangement direction of the warp yarns.

The warp yarn may be made of a material including polyester and polyurethane and the weft yarn may be made of a polypropylene monofilament.

The warp yarn may be woven in the shape of a loop.

The weft yarn may be processed with an inorganic compound having a chemical formula of $Mg_4Al_2$ (OH) $12CO_3.3H_2O$.

One end of the sweat evaporating portion may be inserted between the crown and the sweat band to absorb and evaporate moisture from the sweat stored in the sweat storing portion.

The sweat evaporating portion may surround the lower portion of the visor.

The sweat evaporating portion may be made of polyester and processed with a moisture-absorbent softener containing surfactant.

A headwear including a crown and a visor according to another exemplary embodiment of the present invention includes: a sweat band coupled along a lower edge of the crown having a sweat absorbing portion to absorb sweat and a sweat storing portion to hold the sweat absorbed to the sweat absorbing portion; a sweat evaporating portion surrounding a lower portion of the visor and being inserted between the crown and the sweat band to absorb and evaporate moisture from the sweat stored in the sweat storing portion; and a sweat evaporation-blocking portion surrounding an outer surface of the sweat storing portion to prevent evaporation of the sweat stored in the sweat storing portion toward the crown, wherein the sweat evaporation-blocking portion may surround the outer surface of the sweat storing portion, and the sweat absorbing portion may surround an inner surface of the sweat storing portion and a part of an outer surface of the sweat evaporation-blocking portion.

The sweat absorbing portion may be formed of stretchable woven fabric or knit, and may be made of a material including polyester, polypropylene, and polyurethane.

The sweat absorbing portion may be formed of a double jersey including a polyester layer and a polypropylene layer, and the polyester layer may be processed with a moisture-absorbent softener containing surfactant.

The sweat storing portion may be formed of one of woven fabric, knit, band, non-woven fabric, and form sheet. The sweat storing portion may also include a warp yarn and a weft yarn, wherein the warp yarn being a plurality of warp yarns may be arranged in one direction, and the weft yarn may be arranged in a zigzag manner in a direction that is perpendicular to the arrangement direction of the warp yarn.

The warp yarn may be made of a material including polyester and polyurethane and the weft yarn may be made of a polypropylene monofilament.

The sweat evaporation-blocking portion may be formed of one of stretchable woven fabric, knit, band, non-woven fabric, and sheet, and may be water-repellent finished or waterproofed by a silicon-based agent.

The sweat evaporating portion formed of polyester may be processed with a moisture-absorbent softener containing surfactant.

According to the exemplary embodiments of the present invention, the sweat absorption and evaporation performance is substantially improved and thereby the headwear has superior stain-resistant properties.

DESCRIPTION OF SYMBOLS

Figure 1:
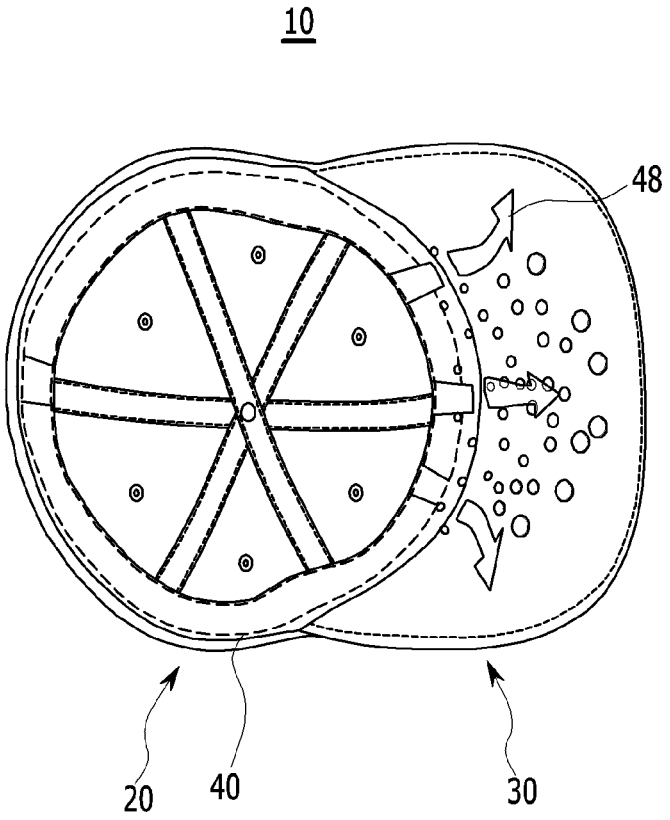
FIG. 1 is a bottom view of a headwear according to an exemplary embodiment of the present invention.

| | |
|---|---|
| 10: headwear | 20: crown |
| 30: visor | 40: sweat band |
| 50: sweat absorbing portion | 60: sweat storing portion |
| 70: sweat evaporation-blocking portion | |

DETAILED DESCRIPTION OF THE PREFERRED EMBODIMENTS

In the following detailed description, only certain exemplary embodiments of the present invention have been shown and described, simply by way of illustration.

As those skilled in the art would realize, the described embodiments may be modified in various different ways, all without departing from the spirit or scope of the present invention Like reference numerals designate like elements throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

In addition, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
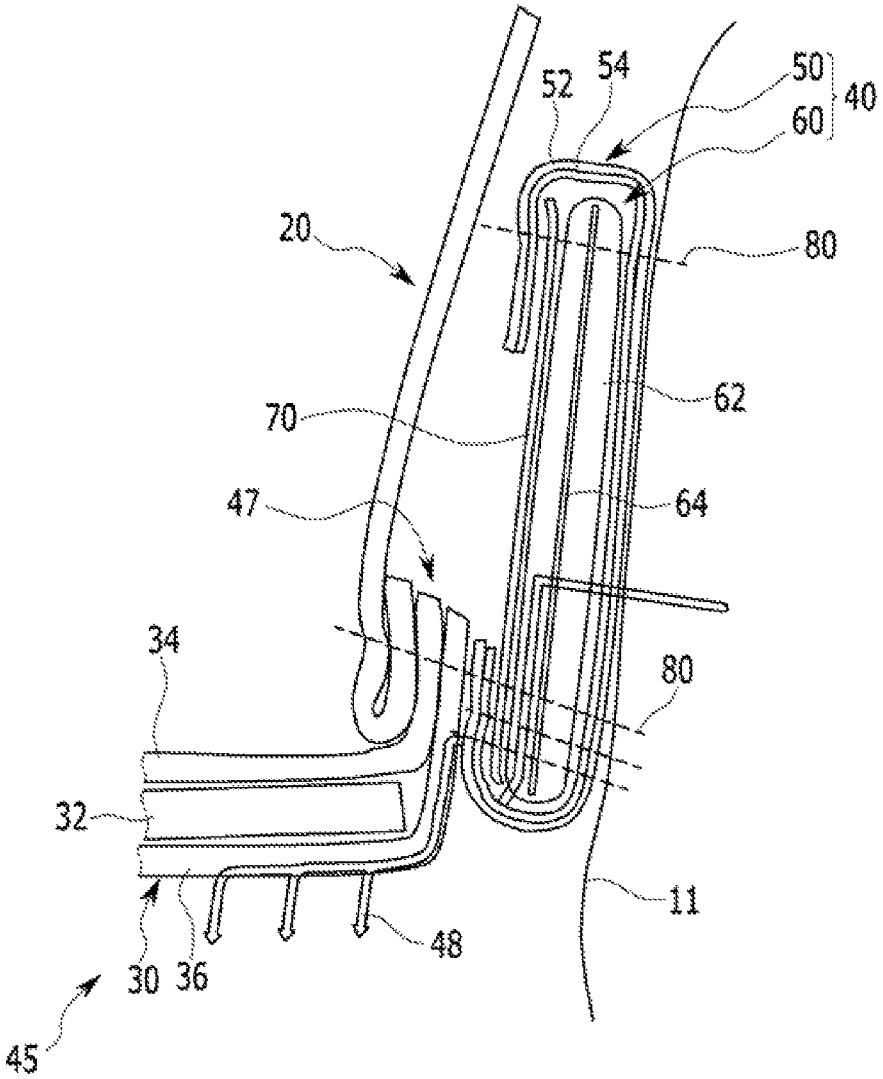
FIG. 2 is a partial cross-sectional view of the headwear according to the exemplary embodiment of the present invention.

FIG. 1 is a bottom view of a headwear according to an exemplary embodiment of the present invention and FIG. 2 is a partial cross-sectional view of the headwear according to the exemplary embodiment of the present invention.

Referring to FIG. 1 and FIG. 2, a headwear 10 according to an exemplary embodiment of the present invention is a typical headwear including a crown 20 and a visor 30.

It is illustrated in the drawing that the headwear is a cap including the visor 30, but the present invention is not limited thereto. Any type of cap including a portion worn on the head of a wearer and a visor 30 that can block sun light is applicable.

The headwear 10 according to the exemplary embodiment of the present invention may include a sweat band 40 coupled along an inner lower edge of the crown 20 and a sweat evaporating portion 45. The sweat band 40 includes a sweat absorbing portion 50 having stretchability and an ability to absorb sweat and a sweat storing portion 60 having stretchability and an ability to store the absorbed sweat. The sweat evaporating portion 45 that surrounds at least a part of the visor 30 and is connected with the sweat band 40 evaporates moisture from the sweat composition stored in the sweat band 40.

Attached end 47 of the sweat evaporating portion 45 may be inserted between the crown 20 and the sweat band 40 to absorb and evaporate moisture from the sweat stored in the sweat storing portion 60.

A moisture pathway 48 is defined by the sweat evaporating portion 45 from the attached end 47 to a lower portion of sweat storing portion 60. Pathway 48 is designated by an arrow showing the moisture migration path with multiple arrow tips indicating evaporation. In another embodiment, not shown, moisture pathway 48 may also pass from attached end 47 to an upper portion of sweat storing portion 60, i.e., to a location above visor core 32.

The sweat absorbing portion 50 may surround an inner surface of the sweat storing portion 60 and a part of an outer surface of the sweat storing portion 60.

The headwear 10 may further include a sweat evaporation-blocking portion 70 surrounding the outer surface of the sweat storing portion 60 and preventing sweat stored in the sweat storing portion 60 from evaporating through the crown 20.

The sweat evaporation-blocking portion 70 surrounds the outer surface of the sweat storing portion 60, and the sweat absorbing portion 50 may surround the inner surface of the sweat storing portion 60 and a part of the outer surface of the sweat evaporation-blocking portion 70.

That is, as shown in FIG. 2, the sweat evaporation-blocking portion 70 surrounds an outer surface of the sweat storing portion 60, and may be coupled by a sewing thread 80, wherein the sweat absorbing portion 50 surrounds the inner surface of the sweat storing portion 60 and a part of the outer surface of the sweat evaporation-blocking portion 70. In addition, the sweat absorbing portion 50, the sweat storing portion 60, and the crown 20 may be coupled by the sewing thread 80.

The sweat evaporation-blocking portion 70 may be made of one of stretchable woven fabric, knit, band, non-woven fabric, and sheet, and can provide wearing comfort to the wearer together with the sweat band 40 made of a stretchable material.

The sweat evaporation-blocking portion 70 is water-repellent finished using a silicon-based agent and thus prevents salty moisture from passing through to the outside while moisture evaporates through smooth ventilation. Or the sweat evaporation-blocking portion 70 is waterproofed so that sweat composition in the sweat storing portion 60 can be prevented from permeating the crown 20.

The sweat evaporation-blocking portion 70 may provide the water proof function or the water repellent function by being coated with a polyurethane film or by being formed of a polyurethane film.

The sweat evaporation-blocking portion 70 can prevent formation of a stain on the outer side by blocking the path to the crown 20 for sweat composition in the sweat storing portion 60.

The visor 30 may include a visor core 32 forming the shape of the visor 30, a visor top 34 surrounding the upper portion of the visor core 32, and a visor bottom 36 surrounding the lower portion of the visor core 32, and the visor top 34 and the visor bottom 36 may form the sweat evaporating portion 45.

One end of the sweat evaporating portion 45 is inserted between the crown 20 and the sweat band 40 such that moisture from the sweat stored in the sweat storing portion 60 is absorbed therethrough and then evaporated.

That is, the sweat evaporating portion 45 is formed by the visor top 32 and the visor bottom 36 of the visor 30, both of which are relatively wide and promptly evaporate moisture, and thereby continuous wearing comfort may be provided to the wearer of the headwear 10.

In addition, the sweat evaporating portion 45 of the headwear 10, according to the exemplary embodiment of the present invention, may be formed preferably by the visor bottom 36 surrounding the lower portion of the visor 30. If the sweat evaporating portion 45 is formed by the visor top 34, the sweat absorbed therethrough may quickly dry by the sun leaving its stain on the visor top 34. Therefore, it has an advantage of being stain-resistant to form the sweat evaporating portion 45 by the visor bottom 36.

The sweat evaporating portion 45 may be made of polyester and processed with a moisture-absorbent softener containing surfactant, to absorb sweat quickly and permeate it widely. The sweat moves to the visor bottom 36 from the sweat storing portion 60 and then permeates rapidly such that moisture evaporates promptly from the relatively wide area, thereby preventing sweat stains.

The sweat absorbing portion 50 that directly contacts the skin of the wearer of the headwear is made of stretchable woven or knitted fabric such that a sweat-absorbing function may be maintained.

The sweat absorbing portion 50 may be made of a material including polyester, polypropylene, and polyurethane.

The polyester may be processed with a moisture-absorbent softener containing surfactant for prompt sweat absorption and wide permeation of the absorbed sweat. The polypropylene being light-weight, may transfer sweat promptly and provide antibacterial and deodorant functions. The polyurethane provides stretchability.

The sweat absorbing portion 50 may be formed of double jersey including a polyester layer 52 and a polypropylene layer 54.

The polyester layer 52 directly contacts the skin of the wearer of the headwear and is processed with moisture-absorbent softener including surfactant so that sweat can be promptly absorbed and widely permeate.

The polypropylene layer 54 can promptly transfer the sweat absorbed by the polyester layer 52 to the sweat storing portion 60.

The total fabric weight may be expressed in percentage terms as 20 to 80 percent of the polyester, 20 to 80 percent of the polypropylene, and 1 to 10 percent of the polyurethane. For example, a double jersey structure for prompt sweat absorption may consist of 71 percent of the polyester, 23 percent of the polypropylene, and 6 percent of the polyurethane. The double jersey structure may include 75-denier polyester to make up most of one side, 50-denier polypropylene to make up most of the other side, and 20-denier polyurethane to be inserted into the polypropylene.

Figure 3:
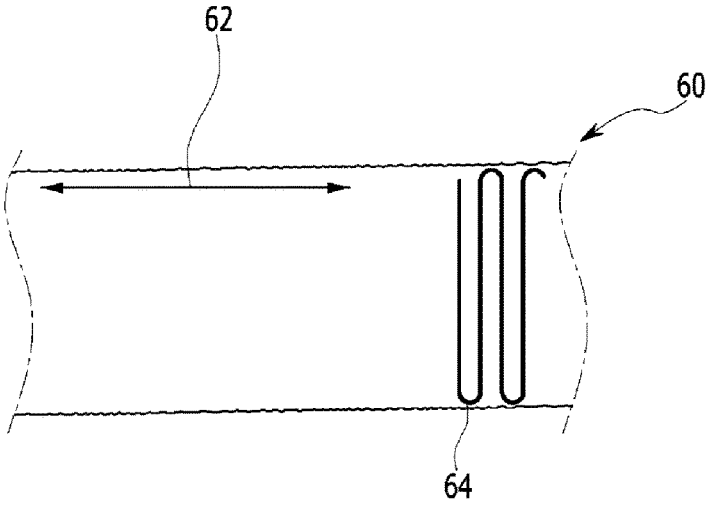
FIG. 3 shows a sweat storing portion applied to the headwear according to the exemplary embodiment of the present invention.

FIG. 3 shows the sweat storing portion applied to the headwear according to the exemplary embodiment of the present invention.

Referring to FIG. 3, the sweat storing portion 60 may function to absorb a large amount of sweat and to promptly transfer the absorbed sweat. The sweat storing portion 60 may be made of one stretchable material that is selected from the group of woven, knit, band, non-woven fabric, and foam sheet.

The sweat storing portion 60 includes a warp yarn 62 and a weft yarn 64. As for the warp yarn 62, a plurality of warp yarns may be arranged in one direction and the weft yarns 64 may be arranged in a zigzag manner in a direction that is perpendicular to the arrangement direction of the warp yarns 62.

The weft yarns 62 may be, for example, made of 300-denier polyester and 100-denier polyurethane. The polyester is processed with the moisture-absorbent softener including surfactant so that sweat can be absorbed promptly and permeate widely. It also may be woven in the shape of a loop to serve as a space to store and then transfer the sweat when a large amount of sweat is absorbed. The loop-shape woven structure functions as a cushion to provide wearing comfort when the headwear is being worn. The polyurethane improves stretchability.

The weft yarns 64 may be formed of a polypropylene mono filament.

Since the polypropylene mono filament has elasticity and rigidity, the polypropylene mono filament functions as a support that maintains the entire shape of the sweat storing portion 60 such that the headwear 10 can be worn easily without being loosened. Also it is light-weight and provides antibacterial and deodorant functions. In particular, the polypropylene of the polypropylene mono filament is mixed with an inorganic compound having a chemical formula of $Mg_4Al_2(OH)12CO_3.3H_2O$ to have the antibacterial and deodorant functions further reinforced, and the thermal control function is added to keep warm or cool, thereby maintaining constant temperature without regard to a body temperature of the wearer.

As shown in FIG. 2, in the headwear 10 according to the exemplary embodiment of the present invention, when sweat comes out from the forehead 11 of the wearer, the sweat is promptly absorbed and permeates widely through the polyester properties of the sweat absorbing portion 50, and the absorbed sweat is promptly transferred by the polypropylene properties of the sweat absorbing portion 50. In addition, moisture in the sweat that is temporarily stored in the sweat storing portion 60 is promptly evaporated through the sweat evaporating portion 45, that is, the wide area of the visor bottom 36, so that the wearer may feel soft and dry and the crown 20 can be prevented from being stained due to the composition of sweat.

In addition, the sweat evaporation-blocking portion 70 is water-repellent finished and thus prevents salty moisture in the sweat storing portion 60 from permeating the crown, thereby achieving stain-resistant properties.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A headwear, comprising:

a crown;

a visor including a visor core forming a shape of the visor, a visor top covering an upper side of the visor core, and a visor bottom covering a lower side of the visor core;

a sweat band coupled along an inner lower edge of the crown and including a stretchable sweat absorbing portion adapted to absorb sweat and a stretchable sweat storing portion adapted to store the sweat absorbed by the sweat absorbing portion; and a sweat evaporation-blocking portion covering an outer surface of the sweat storing portion, the sweat evaporation-blocking portion adapted to prevent the sweat stored in the sweat storing portion from permeating through the crown, wherein:

the sweat absorbing portion is made of polyester and polypropylene, the polyester being treated with a moisture-absorbent softener containing surfactant, the sweat storing portion comprises a plurality of warp yarns and a weft yarn, the plurality of warp yarns are arranged in a first direction, and the weft yarn is arranged in a zigzag manner in a second direction that is perpendicular to the first direction of the plurality of the warp yarns, each of the plurality of the warp yarns being made of polyester and polyurethane and the weft yarn being made of polypropylene mono filament, the polyester of the plurality of the warp yarns being treated with the moisture-absorbent softener containing surfactant, the sweat evaporation-blocking portion is formed of one of stretchable woven fabric, knit, band, non-woven fabric, and sheet and coated with a polyurethane film so as to be waterproofed, the visor bottom is extended to contact a lower portion of the sweat absorbing portion to form a sweat evaporating portion, the sweat evaporating portion being made of polyester treated with the moisture-absorbent softener containing surfactant, a moisture pathway from the sweat storing portion to the visor is formed by a lower portion of the sweat storing portion, the lower portion of the sweat absorbing portion, and the sweat evaporating portion, the sweat absorbing portion surrounds the sweat storing portion and an end portion of the sweat evaporation-blocking portion, and forms an opening through which a part of the sweat evaporation-blocking portion is exposed toward the crown, and the sweat evaporation-blocking portion is interposed between the crown and the sweat storing portion to direct the sweat to the lower portion of the sweat storing portion and guide the sweat along the moisture pathway.

2. The headwear of claim 1, wherein the sweat absorbing portion is made of a double jersey including a polyester layer and a polypropylene layer.

3. The headwear of claim 1, wherein the warp yarn is woven in a shape of a loop.

4. The headwear of claim 1, wherein the weft yarn is treated with an inorganic compound having a chemical formula of $Mg_4Al_2(OH)12CO_3.3H_2O$.

5. The headwear of claim 1, wherein one end of the sweat evaporating portion is inserted between the crown and the sweat band to absorb and evaporate moisture from the sweat stored in the sweat storing portion.

6. The headwear of claim 5, wherein the sweat evaporating portion is formed in a lower portion of the visor.

7. A headwear, comprising:

a crown;

a visor including a visor core forming a shape of the visor, a visor top surrounding an upper portion of the visor core, and a visor bottom covering a lower portion of the visor core;

a sweat band coupled along a lower end edge of the crown including a sweat absorbing portion adapted to absorb sweat and a sweat storing portion adapted to store the sweat absorbed to the sweat absorbing portion;

a sweat evaporation-blocking portion covering an outer surface of the sweat storing portion, the sweat evaporation-blocking portion adapted to prevent the sweat stored in the sweat storing portion from permeating through the crown;

a sweat evaporating portion formed by the visor bottom and connected to the sweat band, extending further away from the sweat band along the visor and being inserted between the crown and the sweat band to absorb and evaporate moisture from the sweat stored in the sweat storing portion; and a moisture pathway formed from a lower portion of the sweat storing portion to the visor bottom via a lower portion of the sweat absorbing portion attached to the lower portion of the sweat storing portion, wherein:

the sweat absorbing portion surrounds the sweat storing portion and an end portion of the sweat evaporation-blocking portion, the sweat absorbing portion is formed of stretchable woven fabric or knit and made of polyester, polypropylene, and polyurethane, the sweat storing portion is formed of one of woven fabric, knit, band, non-woven fabric, and foam sheet, the sweat evaporation-blocking portion is formed of one of stretchable woven fabric, knit, band, non-woven fabric, and sheet, the sweat evaporation-blocking portion being water-repellent finished or waterproofed by a silicon-based agent, and the sweat evaporating portion, the sweat absorbing portion, and the sweat storing portion are treated with a moisture-absorbent softener agent including surfactant to improve sweat absorption and evaporation performance.

8. The headwear of claim 7, wherein the sweat absorbing portion is formed of a double jersey including a polyester layer and a polypropylene layer, and the polyester layer is treated with the moisture-absorbent softener including surfactant.

9. The headwear of claim 7, wherein the sweat storing portion comprises a plurality of warp yarns and a weft yarn, wherein the plurality of warp yarns are arranged in a first direction, and the weft yarn is arranged in a zigzag manner in a second direction that is perpendicular to the first direction of the plurality of the warp yarns.

10. The headwear of claim 9, wherein each of the plurality of warp yarns is made of polyester and polyurethane and the weft yarn is made of a polypropylene mono filament.

* * * * *